US010751762B2

(12) United States Patent
Carter et al.

(10) Patent No.: US 10,751,762 B2
(45) Date of Patent: Aug. 25, 2020

(54) ALUMINUM SAFE DEGREASING AND PRE-SOAK TECHNOLOGY FOR BAKERY AND DELI WARES AND USE THEREOF

(71) Applicant: ECOLAB USA INC., Saint Paul, MN (US)

(72) Inventors: Bethany Carter, Saint Paul, MN (US); Karen Rigley, Saint Paul, MN (US); Lee Jones, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 15/649,798

(22) Filed: Jul. 14, 2017

(65) Prior Publication Data

US 2018/0015509 A1 Jan. 18, 2018

Related U.S. Application Data

(60) Provisional application No. 62/362,842, filed on Jul. 15, 2016.

(51) Int. Cl.

| | |
|---|---|
| ***C11D 1/66*** | (2006.01) |
| ***C11D 3/00*** | (2006.01) |
| ***C11D 3/04*** | (2006.01) |
| ***C11D 3/08*** | (2006.01) |
| ***C11D 3/10*** | (2006.01) |
| ***C11D 3/12*** | (2006.01) |
| ***C11D 3/37*** | (2006.01) |
| ***C11D 3/20*** | (2006.01) |
| ***C11D 3/22*** | (2006.01) |
| ***B08B 9/20*** | (2006.01) |
| ***B08B 3/08*** | (2006.01) |

(52) U.S. Cl.

CPC ..... *B08B 3/08* (2013.01); *C11D 1/66* (2013.01); *C11D 3/0073* (2013.01); *C11D 3/044* (2013.01); *C11D 3/08* (2013.01); *C11D 3/10* (2013.01); *C11D 3/12* (2013.01); *C11D 3/37* (2013.01); *C11D 3/3761* (2013.01)

(58) Field of Classification Search

None

See application file for complete search history.

(56) References Cited

U.S. PATENT DOCUMENTS

| | | | | |
|---|---|---|---|---|
| 5,759,988 | A | 6/1998 | Heile et al. | |
| 7,507,697 | B1 | 3/2009 | Shertok et al. | |
| 8,329,630 | B2 | 12/2012 | Finison et al. | |
| 8,753,453 | B2 | 6/2014 | Martinez-Crowley et al. | |
| 2004/0157762 | A1 | 8/2004 | Meinke et al. | |
| 2008/0015133 | A1* | 1/2008 | Rigley | C11D 3/0047 510/215 |
| 2008/0274942 | A1 | 11/2008 | Tjelta et al. | |
| 2009/0011973 | A1 | 1/2009 | Besse et al. | |
| 2009/0102085 | A1* | 4/2009 | Stolte | C11D 3/044 264/71 |
| 2009/0176687 | A1 | 7/2009 | Tjelta et al. | |
| 2009/0253606 | A1 | 10/2009 | Brooker | |
| 2010/0300493 | A1 | 12/2010 | Snodgrass et al. | |
| 2012/0053104 | A1 | 3/2012 | Olson et al. | |
| 2012/0190199 | A1* | 7/2012 | Reiss | H01L 21/02024 438/692 |
| 2013/0123164 | A1* | 5/2013 | Jones | C11D 17/0047 510/446 |
| 2015/0119312 | A1 | 4/2015 | Sanders et al. | |
| 2015/0136179 | A1* | 5/2015 | Carlhoff | A47L 15/0055 134/18 |
| 2015/0329801 | A1 | 11/2015 | Blattner et al. | |

FOREIGN PATENT DOCUMENTS

| | | | |
|---|---|---|---|
| CN | 1243153 | A | 2/2000 |
| CN | 102433224 | A | 5/2012 |
| CN | 102787029 | A | 11/2012 |
| CN | 103087858 | B | 5/2014 |
| CN | 104371834 | A | 2/2015 |
| CN | 104593165 | A | 5/2015 |
| EP | 0853117 | A1 | 7/1998 |
| EP | 2107105 | A1 | 7/2009 |
| GB | 338121 | | 11/1930 |
| GB | 520140 | | 4/1940 |
| GB | 1172135 | | 11/1969 |
| WO | 9518211 | A1 | 7/1995 |
| WO | 9518215 | A1 | 7/1995 |
| WO | 0043475 | A2 | 7/2000 |
| WO | 2004053049 | A1 | 6/2004 |
| WO | 2005023971 | A1 | 3/2005 |
| WO | 2009124162 | A1 | 10/2009 |
| WO | 2013122978 | A1 | 8/2013 |
| WO | 2014107460 | A1 | 7/2014 |
| WO | 2015055234 | A1 | 4/2015 |

OTHER PUBLICATIONS

PCT/US2017/042037 filed Jul. 14, 2017, "Written Opinion of the International Searching Authority", dated Oct. 17, 2017.

"Trilon M types", BASF The Chemical Company, Technical Information, http://site.saveoncitric.com/trilon_m_info.pdf, 14 pages, May 2007, retrieved on Feb. 24, 2020.

* cited by examiner

*Primary Examiner* — Lorna M Douyon

(74) *Attorney, Agent, or Firm* — McKee, Voorhees & Sease, PLC

(57) ABSTRACT

Aluminum safe degreaser and pre-soak compositions, methods of making, and uses thereof are disclosed. In particular, a solid degreaser composition is described which provides soft metal protection against corrosion, avoids silicate staining, and maintains efficacy for removal of heavy baked-on carbon, shortening, caramelized, and greasy soils from bakery and deli wares.

26 Claims, 3 Drawing Sheets

ALUMINUM SAFE DEGREASING AND PRE-SOAK TECHNOLOGY FOR BAKERY AND DELI WARES AND USE THEREOF

CROSS-REFERENCE TO RELATED APPLICATIONS

This application claims priority and is related to U.S. Provisional Application Ser. No. 62/362,842 filed on Jul. 15, 2016. The entire contents of this patent application are hereby expressly incorporated herein by reference including, without limitation, the specification, claims, and abstract, as well as any figures, tables, or drawings thereof.

FIELD OF THE INVENTION

The invention relates to aluminum safe degreaser and pre-soak compositions and uses thereof. In particular, a solid degreaser composition is described which provides soft metal protection against corrosion and avoids silicate staining, while maintaining efficacy for removal of heavy baked-on carbon, shortening, caramelized, and greasy soils from bakery and deli wares.

BACKGROUND OF THE INVENTION

Pots, pans, dishes, and other wares used for bakery, deli, and other food preparation applications can be particularly difficult to clean. Simply washing the wares with a dish machine is often insufficient due to heavy baked-on carbon, shortening, caramelized, and greasy soils. In an attempt to overcome this issue, it has become common to soak heavily soiled wares in solutions intended to loosen the soils before putting the wares through a normal wash cycle.

It is important that degreaser or pre-soak solutions being utilized to loosen soils from aluminum wares are not corrosive or damaging to the aluminum. This is particularly important for the cleaning of items such as deli and bakery pans, which are often made of aluminum or have aluminum coatings.

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pellet forms of detergents, including improved handling, enhanced safety, elimination of component segregation during transportation and storage, and increased concentrations of active components within the composition. Because of these benefits, solid block cleaning compositions, such as those disclosed in Fernholz, et al., U.S. Pat. Nos. Re 32,763, 32,818, 4,680,134 and 4,595,520, have quickly replaced the conventional composition forms in commercial and institutional markets.

Accordingly, it is an objective of the invention to develop a program for degreasing and pre-soaking bakery and deli wares in a food retail service (FRS) environment, where heavy baked-on carbon, shortening, caramelized, and grease soils are present. An objective is to develop an innovative aluminum-safe degreaser and pre-soak system that offers superior performance of pre-soak cleaning of food preparation wares.

Other objects, advantages and features of the embodiments of the disclosure will become apparent from the following specification taken in conjunction with the accompanying drawings.

BRIEF SUMMARY OF THE INVENTION

The invention relates to solid compositions and methods of making and using the solid compositions for degreasing and pre-soaking wares to loosen soils before washing the wares. The compositions according to embodiments of the invention are as effective as liquid degreasing compositions, but have the added benefit of being in solid form, avoiding the need for personal protective equipment for handling the composition as the solid can be packaged such that no direct contact with skin is required.

In one embodiment, a solid composition which includes one or more sources of alkalinity, a corrosion inhibitor, one or more surfactants, a polyacrylate polymer and a chelant. In some aspects, the solid composition is used to treat metal wares before washing by diluting the solid composition and submerging the metal wares in the diluted degreaser composition.

In another embodiment, a solid composition includes at least one alkalinity source comprising one or more of an alkali metal hydroxide, an alkali metal silicate, or an alkali metal carbonate, at least one corrosion inhibitor comprising a silicate and/or metasilicates, at least one surfactant comprising at least one nonionic surfactant, a polyacrylate polymer, and at least one chelant.

In another embodiment a solid degreaser composition includes between about 1 wt-% and about 13 wt-% of a primary alkalinity source, between about 5 wt-% and about 40 wt-% of a silicate corrosion inhibitor, between about 40 wt-% and about 90 wt-% of a secondary alkalinity source, between about 0.01 wt-% and about 6 wt-% of an polyacrylate polymer, between about 2 wt-% and about 20 wt-% of at least one nonionic surfactant, and between about 1 wt-% and 8 wt-% of a chelant.

A method of making the solid degreaser compositions is also provided. A solid premix including a builder, a metal protectant, a solid non-ionic surfactant, and a chelant is prepared first, followed by a caustic liquid premix including a solvent, an polyacrylate polymer, and an alkalinity source. The caustic liquid premix and the solid premix are combined. A dye-surfactant liquid premix is then prepared which includes a nonionic surfactant and may optionally include one or more functional ingredients. The dye-surfactant liquid premix is combined with the solid premix and caustic liquid premix to form a powder. The powder is then pressed into a solid form.

Once the solid degreaser composition is formed, it may be added into a dispenser with water and dispensed as a diluted degreaser solution. The degreaser solution is generally dispensed into a soaking vessel to soak, for example, aluminum bakery and deli wares before washing. Alternatively, the solid degreaser may be added directly into the soaking vessel and diluted with water. In an embodiment, a method of treating wares before washing includes: providing a solid degreaser composition according to one of the embodiments of the invention, diluting the solid degreaser composition in water, and submerging the wares in the diluted degreaser composition.

In a further embodiment, a method of soaking aluminum bakery and deli wares prior to washing includes providing a solid pre-soak block made by the methods of an embodiment of the invention and/or a solid block degreaser composition according to one of the embodiments of the invention, adding the solid pre-soak block with water to a dispenser and dispensing diluted pre-soak solution formed from the solid pre-soak block and the water into a soak vessel, or adding the solid pre-soak block directly into a soak vessel for dilution, and soaking metal bakery and deli wares in the diluted pre-soak solution in the soak vessel.

In a still further embodiment, the compositions and methods provide a solid degreasing chemistry used in a dispenser to dispense at a constant dilution rate. In an embodiment, the solid composition provides customers with concentrated chemistry and improves the safety of handling the concentrated chemistry by not requiring the use of personal protective equipment. Further, the pH of the use composition is low enough to not require the use of personal protective equipment, nor is the composition corrosive.

Figure 1:
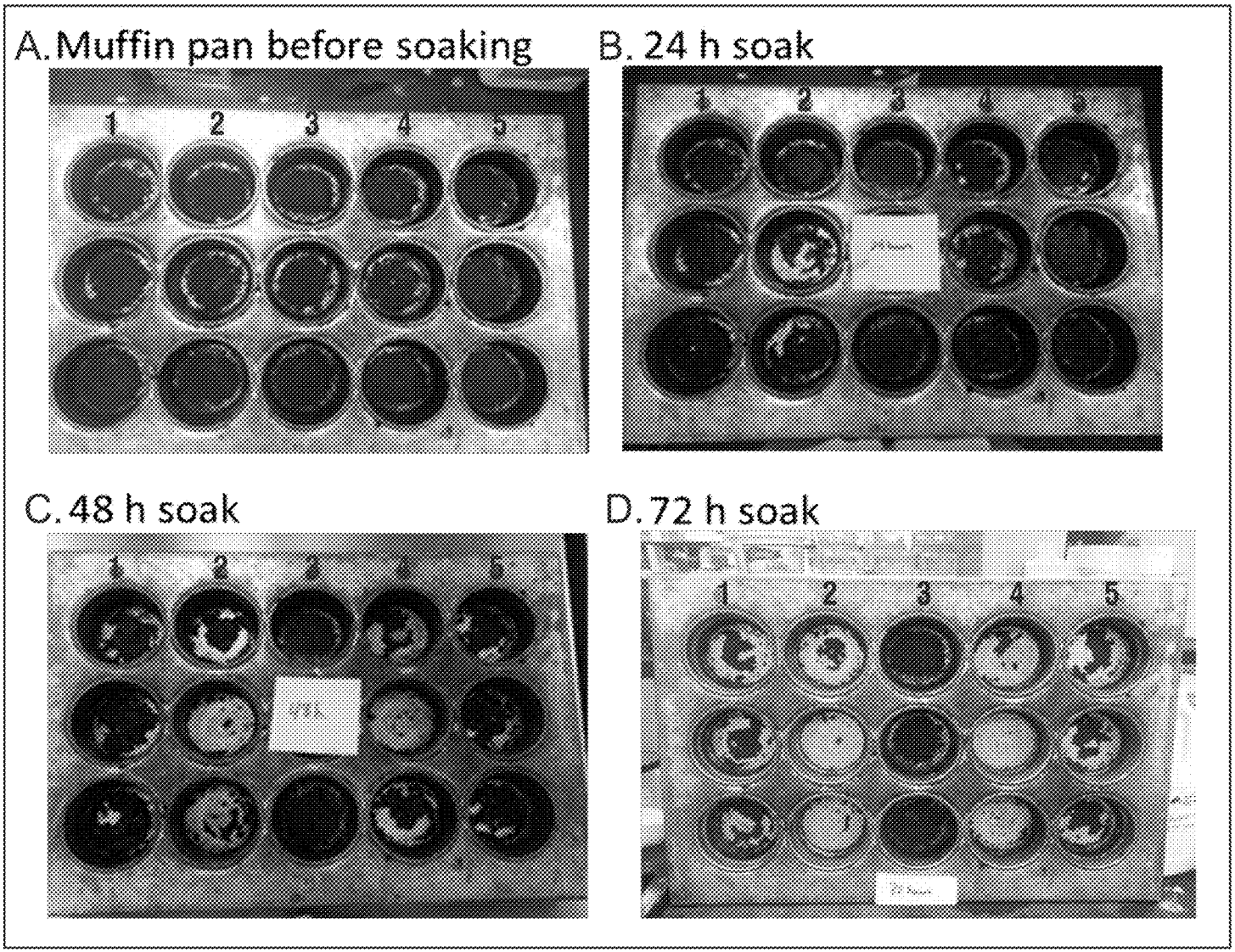
FIG. 1 shows the results of a performance test of an embodiment of the degreaser compositions at different soak times compared to other degreaser and pre-soak compositions.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

Solid degreaser and pre-soak compositions for removing baked-on food soils from metal ware are provided. Methods of making and using the solid composition are provided. The solid composition has many advantages over existing degreaser formulations in that the composition exhibits superior performance for the removal of carbonized bakery and deli soils while providing soft metal protections against corrosion without causing silicate staining on wares and floors. Secondly, the solid degreaser chemistry provides a more sustainable solution through concentration of chemistry resulting in a smaller product foot print, specifically related to packaging, transportation, and storage. A further benefit from the solid degreaser composition is that personal protective equipment (PPE) is not required to handle the composition in diluted form.

The embodiments of this invention are not limited to particular formulations, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful to assist in reducing redepositing of the removed soil onto the surface being cleaned.

As used herein, the term "disinfectant" refers to an agent that kills all vegetative cells including most recognized pathogenic microorganisms, using the procedure described in *A.O.A.C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs.

As used herein, the term "microemulsion" refers to thermodynamically stable, isotropic dispersions consisting of nanometer size domains of water and/or oil stabilized by an interfacial film of surface active agent characterized by ultra-low interfacial tension.

As used herein, the phrase "meat product" refers to all forms of animal flesh, including the carcass, muscle, fat, organs, skin, bones and body fluids and like components that form the animal. Animal flesh includes, but is not limited to, the flesh of mammals, birds, fishes, reptiles, amphibians, snails, clams, crustaceans, other edible species such as lobster, crab, etc., or other forms of seafood. The forms of animal flesh include, for example, the whole or part of animal flesh, alone or in combination with other ingredients. Typical forms include, for example, processed meats such as cured meats, sectioned and formed products, minced products, finely chopped products, ground meat and products including ground meat, whole products, and the like.

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt-%, and most preferably, the amount of phosphate is less than 0.01 wt %.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

As used herein, the term "soil" refers to fat, carbon, and protein based materials associated with the preparation and cooking of deli and bakery products. Such soil types include heavy baked-on carbon, baked-on shortening, caramelized sugars, grease, oil, fatty soils, and baked-on protein.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

As used herein, the term "ware" refers to items such as eating and cooking utensils, dishes, and other food preparation items. Wares specific to deli and bakery applications include bakery pans, muffin pans, baguette pans, skewers, metal baskets, and the like. As used herein, the term "warewashing" refers to washing, cleaning, or rinsing ware. Ware refers to items made of metal or plastic. In particular, the wares may be made of soft metals such as aluminum.

The terms "water soluble" and "water dispersible" as used herein, means that the polymer is soluble or dispersible in water in the inventive compositions. In general, the polymer should be soluble or dispersible at 25° C. at a concentration of 0.0001% by weight of the water solution and/or water carrier, preferably at 0.001%, more preferably at 0.01% and most preferably at 0.1%.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

Compositions

In one embodiment, a solid composition is provided for degreasing and pre-soaking aluminum bakery and deli wares while protecting the wares from corrosion. The solid composition includes a primary alkalinity source, which is preferably an alkali metal hydroxide, an alkali metal carbonate, an alkali metal silicate, or an alkali metal metasilicate. The alkalinity source maintains the pH of the solid when diluted to make a use solution in the alkaline range in order to preserve the detergency properties of the composition. The alkalinity source may be present at from about 1 wt-% to about 13 wt-% of the composition. The composition may further include a builder, which may also function as a secondary alkalinity source. The builder may be present at from about 40 wt-% to about 90 wt-% of the solid composition and is preferably an alkali metal carbonate. The composition further includes at least one metal protectant for inhibiting corrosion of aluminum pans and bakery wares. Preferably, the corrosion inhibitor is a sodium metasilicate or a sodium silicate and can serve as an additional source of alkalinity. The metal protectant may be present at from about 5 wt-% to about 40 wt-% of the solid composition. The composition further includes at least one nonionic surfactant. Surfactants adsorb at the interfaces between air and water or between oil and water and serve to lift oily soils and wash them away with water. Preferably the composition includes both a nonionic surfactant and a polyacrylate polymer. The composition may include from about 0.01 wt-% to about 6 wt-% of at least one polyacrylate polymer and from about 2 wt-% to about 20 wt-% of at least one nonionic surfactant. The solid composition also includes at least one chelating agent or chelant. The chelating agent is preferably Alanine, N,N-bis(carboxymethyl)-,trisodium salt, which is an effective chelating agent. The chelating agent may be present at from about 1 wt-% to about 8 wt-% of the solid composition.

In one embodiment, a solid composition for degreasing and pre-soaking aluminum bakery and deli wares while protecting the wares from corrosion comprises, consists of and/or consists essentially of a primary alkalinity source, a builder, which may also function as a secondary alkalinity source, at least one metal protectant (also referred to as a corrosion inhibitor), at least one surfactant, and at least one chelating agent or chelant.

Primary Source of Alkalinity

The solid cleaning compositions include a primary alkalinity source. The alkalinity source is preferably an alkali hydroxide. The alkalinity source of the degreaser composition can include, for example, an alkali metal hydroxide, alkali metal carbonate, or alkali metal silicate. Examples of suitable alkalinity sources include, but are not limited to: sodium hydroxide, potassium hydroxide, sodium carbonate, potassium carbonate, sodium silicate, sodium metasilicate, potassium silicate or a mixture of alkali metal sodium hydroxide, alkali metal carbonate, and alkali metal silicate. The alkalinity source controls the pH of the resulting solution when water is added to the detergent composition to form a use solution. The pH of the use solution must be maintained in the alkaline range in order to provide sufficient detergency properties. In one embodiment, the pH of the use solution is between approximately 10 and approximately 13. Particularly, the pH of the use solution is about 11-12. If the pH of the use solution is too low, for example, below approximately 10, the use solution may not provide adequate detergency properties. Further, at lower pH levels, the silicate species become unstable and may precipitate out of solution. If the pH of the use solution is too high, for example, above approximately 13, the use solution may be too alkaline and attack or damage the surface to be cleaned. A further consideration for the pH is that if the composition is too alkaline, a user would be required to wear PPE. However, if the pH of the composition is at or below about 11.5 pH, PPE is not required. Therefore, it is desirable for the pH of the composition in diluted use form to be between about 11 and about 12 in order for the composition to be effective, but not corrosive to human skin.

Preferably, the primary alkalinity source is an alkali metal hydroxide. Preferred alkali metal hydroxides include sodium hydroxide and potassium hydroxide. More preferably, the primary alkalinity source is sodium hydroxide.

In embodiments, a primary source of alkalinity is present at an amount of about 1 to about 13 percent by weight, preferably 2 to about 10 percent by weight, and more preferably about 3 to about 7 percent by weight of the total solid composition.

Secondary Source of Alkalinity

The solid cleaning compositions include a secondary alkalinity source. The additional alkalinity source includes a carbonate-based alkalinity source. Suitable carbonates include alkali metal carbonates (including, for example, sodium carbonate and potassium carbonate), bicarbonate, sesquicarbonate, and mixtures thereof s. Use of a carbonate-based alkalinity source can assist in providing solid compositions, as the carbonate can act as a hydratable salt.

Alkali metal carbonates which may be used include sodium carbonate, potassium carbonate, sodium or potassium bicarbonate or sesquicarbonate, among others. Preferred carbonates include sodium and potassium carbonates. Most preferred, the carbonate is sodium carbonate. The sodium carbonate can be of light density or heavy density.

When the source of alkalinity is present in the composition at a concentration of at least about 1 wt.-%, the composition emulsifies fats and oils present on the surface of treatment. When the source of alkalinity is present in a concentration of about 3 wt-% or greater, the composition emulsifies, suspends, and separates the oils and fats after treatment.

In embodiments, a secondary source of alkalinity is present in an amount of about 30 to about 90 percent by weight, preferably about 40 to about 80 percent by weight, and more preferably about 50 to about 70 percent by weight of the total solid composition.

Silicate Corrosion Inhibitor

The solid cleaning compositions and methods include a silicate as a corrosion inhibitor. A benefit of using a silicate as a metal protectant is that it can also serve as an additional alkalinity source. In some embodiments, this may be beneficial. An effective amount of an alkaline metal silicate or hydrate thereof can be employed in the compositions and processes of the disclosure to form a stable solid cleaning compositions that can have metal protecting capacity.

Suitable silicates include, but are not limited to, alkali metal silicates that are powdered, particulate or granular silicates which are either anhydrous or preferably which contain water of hydration. The metal protectant may preferably be sodium silicate, potassium silicate, potassium metasilicate, or sodium metasilicate. Most preferred, the silicate is sodium silicate. Sodium silicate may be preferred over sodium metasilicate, as sodium metasilicate may cause discoloration of aluminum surfaces.

Silicate corrosion inhibitor may be present in the solid composition at an amount of about 5 to about 40 percent by weight, preferably 10 to about 30 percent by weight, and more preferably about 15 to about 20 percent by weight of the total solid composition.

Chelant/Detergent Builder

The solid cleaning compositions may include a chelant. Chelants include chelating agents (chelators), sequestering agents (sequestrants), detergent builders, and the like. Examples of chelants include, but are not limited to, phosphonates, phosphates, aminocarboxylates and their derivatives, pyrophosphates, polyphosphates, ethylenediamene and ethylenetriamene derivatives, hydroxyacids, and mono-, di-, and tri-carboxylates and their corresponding acids. Other exemplary chelants include aluminosilicates, nitroloacetates and their derivatives, and mixtures thereof. Still other exemplary chelants include aminocarboxylates, including salts of methyl glycine diacetic acid (MGDA), ethylenediaminetetraacetic acid (EDTA), hydroxyethylenediaminetetraacetic acid (HEDTA), and diethylenetriaminepentaacetic acid. Chelants can be water soluble, and/or biodegradable. Other exemplary chelants include EDTA (including tetra sodium EDTA), TKPP (tetrapotassium pyrophosphate), PAA (polyacrylic acid) and its salts, phosphonobutane carboxylic acid, Alanine,N,N-bis(carboxymethyl)-,trisodium salt, and sodium gluconate. In some embodiments, the selected chelant is substantially free of phosphorus. The chelant may also serve as a solidifying agent to help form the solid-composition, such as sodium salts of citric acid.

Preferably, the chelant is a sodium salt of aminocarboxylates. More preferably, the chelant is methyl glycine diacetic acid (MGDA). Synergistic water conditioning is achieved when using methyl glycine diacetic acid (MGDA) in combination with poly acrylic acids and its salts. In exemplary embodiments, the chelant is present in the solid composition at an amount of about 1 to about 8 percent by weight, preferably about 2 to about 6 percent by weight, and more preferably about 4 to about 5 percent by weight of the total solid composition.

Surfactants

In some embodiments, the compositions include one or more surfactants. In preferred embodiments, the compositions include one or more nonionic surfactants. Surfactants suitable for use with the compositions include, but are not limited to, nonionic surfactants, acrylic polymers, cationic surfactants, amphoteric surfactants, and zwitterionic surfactants. Preferably, the solid composition comprises at least one nonionic surfactant and at least one acrylic polymer.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water-soluble compound having the desired degree of balance between hydrophilic and hydrophobic properties. Useful nonionic surfactants include:

Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in the compositions for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions containing amylase and/or lipase enzymes because of potential incompatibility.

Examples of nonionic low foaming surfactants include:

Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

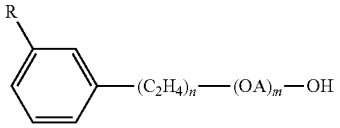

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n\ (C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions correspond to the formula: $P[(C_3H_6O)_n\ (C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or $—(C_2H_4O)_xH$, where x is in the range of from 1 to 3.

A useful class of non-ionic surfactants include the class defined as alkoxylated amines or, most particularly, alcohol alkoxylated/aminated/alkoxylated surfactants. These nonionic surfactants may be at least in part represented by the general formulae: $R^{20}—(PO)_sN—(EO)_tH$, $R^{20}—(PO)_sN—(EO)_tH(EO)_tH$, and $R^{20}—N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}—(PO)_v—N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Preferably, the nonionic surfactants are alcohol ethoxylates. More preferably, the alcohol ethoxylates are linear alcohol ethoxylates. Preferred commercially available linear alcohol ethoxylates include Tomadol 1-3 (Air Products; Allentown, Pa.), Neodol 25-7E (Shell Chemicals; The Hague, The Netherlands), Surfonic L24-7 (Huntsman; The Woodlands, Tex.), Genapol LA 070 S (Clariant; Muttenz, Switzerland), Dehydol LT 7 (BASF; Ludwigshafen, Germany), Tomadol 25-7 (Air Products; Allentown, Pa.), Lutensol AT-25 (BASF; Ludwigshafen, Germany), and Teric 17A25 (Huntsman; The Woodlands, Tex.). The nonionic surfactants may comprise more than one linear alcohol ethoxylate.

Nonionic surfactants are present in the present composition at an amount of about 2 to about 15 percent by weight, preferably about 5 to about 10 percent weight, and more preferably about 7 to about 8 percent by weight of the total solid composition.

Semi-Polar Nonionic Surfactants

The semi-polar type of nonionic surface active agents are another class of nonionic surfactant useful in embodiments of the compositions. Generally, semi-polar nonionics are high foamers and foam stabilizers, which can limit their application in CIP systems. However, within compositional embodiments designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

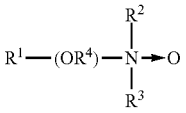

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

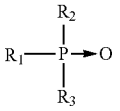

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis (hydroxymethyl)tetradecylphosphine oxide.

Semi-polar nonionic surfactants useful herein also include the water soluble sulfoxide compounds which have the structure:

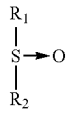

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R-(EO)_5(PO)_4$) and Dehypon LS-36 ($R-(EO)_3(PO)_6$); and capped alcohol alkoxylates, such as Plurafac LF221 and Tegoten EC11; mixtures thereof, or the like.

Anionic Surfactants

Also useful in the compositions are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

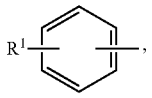

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

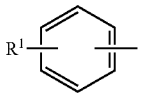

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

According to one embodiment of the compositions, one or more high molecular weight polyacrylates are used as a corrosion inhibitor. The polyacrylate contains a polymerization unit derived from the monomer selected from the group consisting of acrylic acid, methacrylic acid, methyl acrylate, methyl methacrylate, ethyl acrylate, ethyl methacrylate, butyl acrylate, butyl methacrylate, iso-butyl acrylate, iso-butyl methacrylate, iso-octyl acrylate, iso-octyl methacrylate, cyclohexyl acrylate, cyclohexyl methacrylate, glycidyl acrylate, glycidyl methacrylate, hydroxyethyl acrylate, hydroxypropyl acrylate, 2-hydroxyethyl acrylate, 2-hydroxyethyl methacrylate, 2-hydroxypropyl acrylate, 2-hydroxypropyl methacrylate. and hydroxypropyl methacrylate and a mixture thereof, among which acrylic acid. methacrylic acid, methyl acrylate, methyl methacrylate, butyl acrylate, butyl methacrylate, iso-butyl acrylate, iso-butyl methacrylate, hydroxyethyl acrylate, 2-hydroxyethyl acrylate, 2-hydroxyethyl methacrylate, 2-hydroxypropyl acrylate, and 2-hydroxypropyl methacrylate, and a mixture thereof are preferred.

The above-mentioned acrylate monomers can be selected from the group consisting of methyl acrylate, methyl methacrylate, butyl acrylate, 2-phenoxy ethyl acrylate, ethoxylated 2-phenoxy ethyl acrylate, 2-(2-ethoxyethoxy)ethyl acrylate, cyclic trimethylolpropane formal acrylate, .beta.-carboxyethyl acrylate, lauryl(meth)acrylate, isooctyl acrylate, stearyl(meth)acrylate, isodecyl acrylate, isoborny (meth)acrylate, benzyl acrylate, hydroxypivalyl hydroxypivalate diacrylate, ethoxylated 1,6-hexanediol diacrylate, dipropylene glycol diacrylate, ethoxylated dipropylene glycol diacrylate, neopentyl glycol diacrylate, propoxylated neopentyl glycol diacrylate, ethoxylated bisphenol-A di(meth)acrylate, 2-methyl-1,3-propanediol diacrylate, ethoxylated 2-methyl-1,3-propanediol diacrylate, 2-butyl-2-ethyl-1,3-propanediol diacrylate, ethylene glycol dimethacrylate, diethylene glycol dimethacrylate, 2-hydroxyethyl methacrylate phosphate, tris(2-hydroxy ethyl)isocyanurate triacrylate, pentaerythritol triacrylate, ethoxylated trimethylolpropane triacrylate, propoxylated trimethylolpropane triacrylate, trimethylolpropane trimethacrylate, pentaerythritol tetraacrylate, ethoxylated pentaerythritol tetraacrylate, ditrimethylolpropane tetraacrylate, propoxylated pentaerythritol tetraacrylate, pentaerythritol tetraacrylate, dipentaerythritol hexaacrylate, (meth)acrylate, hydroxyethyl acrylate (HEA), 2-hydroxyethyl methacrylate (HEMA), tripropylene glycol di(meth)acrylate1,4-butanediol di(meth) acrylate, 1,6-hexanediol di(meth)acrylate, allylated cyclohexyl di(meth)acrylate, isocyanurate di(meth)acrylate, ethoxylated trimethylol propane tri(meth)acrylate, propoxylated glycerol tri(meth)acrylate, trimethylol propane tri (meth)acrylate, and tris(acryloxyethyl)isocyanurate, and a mixture thereof.

Polyacrylic acids, $(C_3H_4O_2)_n$ or 2-Propenoic acid homopolymer; Acrylic acid polymer; Poly(acrylic acid); Propenoic acid polymer; PAA have the following structural formula:

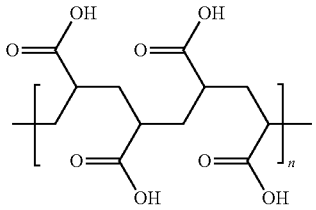

where n is any integer.

Examples of polyacrylates (polyacrylic homopolymers) which may be used for in the compositions include sodium polyacrylate. Exemplary polyacrylates include X-0125-APN-20, Acusol 929, Sokalan PA 30 CLPN, Colloid APN 20, Belclene 200, Optidose 4210, Acusol 445N, and Alcosperse 602N.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

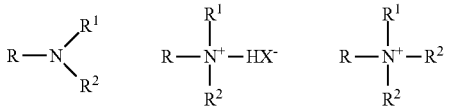

in which, R represents an alkyl chain, R', R'', and R''' may be either alkyl chains or aryl groups or hydrogen and X represents an anion. The amine salts and quaternary ammonium compounds are preferred for practical use in the compositions due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions include for example those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

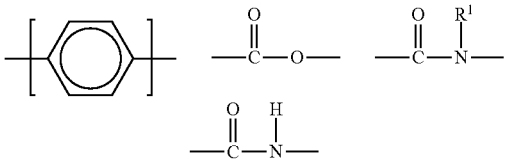

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

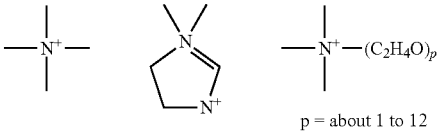

p = about 1 to 12

-continued

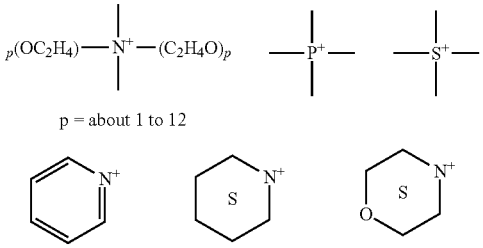

p = about 1 to 12 or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water-soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component. In alternative embodiments, the solid composition is substantially free of cationic surfactants.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application generally have the general formula:

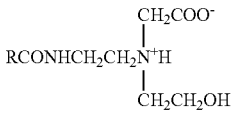

(MONO)ACETATE

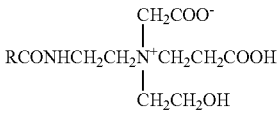

(DI)PROPIONATE

Neutral pH Zwitterion

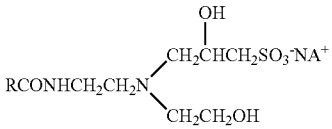

AMPHOTERIC SULFONATE wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety. In alternative embodiments, the solid composition is substantially free of amphoteric surfactants.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

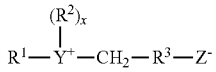

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylaonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate;

and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

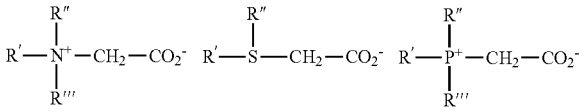

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in embodiments of the compositions include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety. In alternative embodiments, the solid composition is substantially free of zwitterionic surfactants.

Polyacrylate Polymers

The solid detergent compositions further include a polyacrylate polymer to add detergency, sequester hardness, and/or act as an anti-redisposition agent. Polyacrylate polymers include polyacrylic acid polymers, preferably low molecular weight acrylate polymers. Polyacrylic acid homopolymers can contain a polymerization unit derived from the monomer selected from the group consisting of acrylic acid, methacrylic acid, methyl acrylate, methyl methacrylate, ethyl acrylate, ethyl methacrylate, butyl acrylate, butyl methacrylate, iso-butyl acrylate, iso-butyl methacrylate, iso-octyl acrylate, iso-octyl methacrylate, cyclohexyl acrylate, cyclohexyl methacrylate, glycidyl acrylate, glycidyl methacrylate, hydroxyethyl acrylate, hydroxypropyl acrylate, 2-hydroxyethyl acrylate, 2-hydroxyethyl methacrylate, 2-hydroxypropyl acrylate, 2-hydroxypropyl methacrylate, and hydroxypropyl methacrylate and a mixture thereof, among which acrylic acid. methacrylic acid, methyl acrylate, methyl methacrylate, butyl acrylate, butyl methacrylate, iso-butyl acrylate, iso-butyl methacrylate, hydroxyethyl acrylate, 2-hydroxyethyl acrylate, 2-hydroxyethyl methacrylate, 2-hydroxypropyl acrylate, and 2-hydroxypropyl methacrylate, and a mixture thereof are preferred.

Preferred are polyacrylic acids, $(C_3H_4O_2)_n$ or 2-Propenoic acid homopolymers; Acrylic acid polymer; Poly(acrylic acid); Propenoic acid polymer; PAA have the following structural formula:

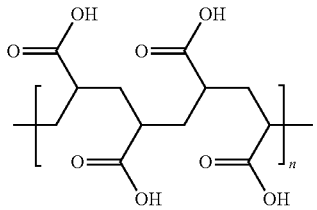

where n is any integer.

One source of commercially available polyacrylates (polyacrylic acid homopolymers) useful for the invention includes the Acusol 445 series from The Dow Chemical Company, Wilmington Del., USA, including, for example, Acusol® 445 (acrylic acid polymer, 48% total solids) (4500 MW), Acusol® 445N (sodium acrylate homopolymer, 45% total solids)(4500 MW), and Acusol®445ND (powdered sodium acrylate homopolymer, 93% total solids)(4500 MW). Other polyacrylates (polyacrylic acid homopolymers) commercially available from Dow Chemical Company suitable for the compositions include, but are not limited to Acusol 929 (10,000 MW) and Acumer 1510. Yet another example of a commercially available polyacrylic acid is AQUATREAT AR-6 (100,000 MW) from AkzoNobel Strawinskylaan 2555 1077 ZZ Amsterdam Postbus 75730 1070 AS Amsterdam. Other suitable polyacrylates (polyacrylic acid homopolymers) for use in the invention include, but are not limited to those obtained from additional suppliers such as Aldrich Chemicals, Milwaukee, Wis., and ACROS Organics and Fine Chemicals, Pittsburgh, Pa., BASF Corporation and SNF Inc. Additional disclosure of polyacrylates suitable for use in the solid rinse aid compositions is disclosed in U.S. Application Ser. No. 62/043,572 which is herein incorporated by reference in its entirety.

The polyacrylate polymer may be in an amount of from about 0.1 wt. % to about 10 wt. %, from about 0.5 wt. % to about 10 wt. %, from about 1 wt. % to about 10 wt. %, from about 1 wt. % to about 5 wt. %, from about 1.5 wt. % to about 5 wt. %, and more preferably from about 2.5 wt. % to about 3.5 wt. % of the solid detergent composition.

Additional Functional Ingredients

The components of the detergent composition can further be combined with various functional components suitable for use in degreasing, ware wash, and soaking applications. In some embodiments, few or no additional functional ingredients are disposed therein. In other embodiments, additional functional ingredients may be included in the compositions.

The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications. Alternatively, functional ingredients may be included for aesthetic purposes, such as dyes and fragrances. The precise nature of these additional components, and levels of incorporation thereof, will depend on the physical form of the composition and the nature of the cleaning operation for which it is to be used.

Suitable additional ingredient include, but are not limited to additional surfactants, builders, chelating agents, dye transfer inhibiting agents, viscosity modifiers, dispersants, enzymes, bleaches, bleach activators, brighteners, suds suppressors, dyes, perfumes, carriers, hydrotropes, solvents, processing aids, pigments, antimicrobials, pH buffers, and mixtures thereof.

In some embodiments, the compositions may include defoaming agents, antiredeposition agents, bleaching agents, solubility modifiers, dispersants, rinse aids, metal protecting agents, stabilizing agents, corrosion inhibitors, additional sequestrants and/or chelating agents, fragrances and/or dyes, rheology modifiers or thickeners, hydrotropes or couplers, buffers, solvents and the like. The present composition may include from about 0 wt-% to about 40 wt-%, about 0 wt-% to about 30 wt-%, or about 1 wt-% to about 20 wt-% of one or more additional functional ingredients. In particular, the composition may contain a solvent and one or more dyes and fragrances as described below.

Solvent

In some embodiments, the compositions include a solvent. The solvent provides a medium which dissolves, suspends, or carries the other components of the composition. The solvent may include primarily water which can promote solubility and work as a medium for reaction and equilibrium. The carrier can include or be primarily an organic solvent, such as simple alkyl alcohols, e.g., ethanol, isopropanol, n-propanol, benzyl alcohol, and the like. In certain embodiments, the present composition includes about 0 wt-% to about 30 wt-% solvent, about 1 wt-% to about 20 wt-% solvent, or about 1.5 wt-% to about 10 wt-% solvent.

Processing Aids

The compositions may include various processing aids. According to one embodiment the solid composition includes at least one saccharide. Suitable saccharides include mono-, di- and polysaccharides containing 3 or more saccharide units. Suitable saccharides can have a cyclic or non-cyclic structure. Exemplary saccharides include, but are not limited to glucose, fructose, lactulose galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose, amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, malto dextrin, cyclodextrin, glycogen and oligio fructose, sodium carboxymethylcellulose, linear sulfonated O-(1,4)-linked D-glucose polymers, Y-cyclodextrin and the like. Sugar alcohols may also be suitable.

Sucrose, fructose, inulin, lactulose, maltose and combinations thereof, may be particularly suitable. In a preferred embodiment, sucrose is a preferred processing aid for a solid composition. In certain embodiments, the present composition includes about 0 wt-% to about 5 wt-% processing aid, about 0.01 wt-% to about 5 wt-% processing aid, about 0.1 wt-% to about 5 wt-% processing aid, or about 1 wt-% to about 3 wt-% processing aid, or about 1.5 wt-% to about 2 wt-% processing aid.

Dyes and Fragrances

The compositions may include dyes and fragrances. Various dyes, odorants including perfumes, and other aesthetic enhancing agents may also be included in the degreasing composition. Dyes may be included to alter the appearance of the composition, as for example, any of a variety of FD&C dyes, D&C dyes, and the like. Additional suitable dyes include Liquitint Brilliant Orange (Milliken & Company, Spartanburg, S.C.), Direct Blue 86 (Miles Chemical Co; Arleta, Calif.), Fastusol Blue (Mobay Chemical Corp.; Pittsburgh, Pa.), Acid Orange 7 (American Cyanamid; Wayne, N.J.), Basic Violet 10 (Sandoz; Germany), Acid Yellow 23 (GAF, Wayne, N.J.), Acid Yellow 17 (Sigma-Aldrich; St. Louis, Mo.), Sap Green (Keystone Aniline and Chemical; Chicago, Ill.), Metanil Yellow (Keystone Aniline and Chemical; Chicago, Ill.), Acid Blue 9 (Emerald Hilton Davis; Cincinnati, Ohio), Sandolan Blue/Acid Blue 182 (Sandoz, Germany), Hisol Fast Red (Capitol Color and Chemical), Acid Green 25 (Novartis, Switzerland), Pylakor Acid Bright Red (Pylam; Tempe, Ariz.), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Dyes may be present in the solid composition at an amount of about 0.005 to about 0.5 wt-%, preferably about 0.01 to about 0.25 wt-%, and more preferably about 0.05 to about 0.15 wt-% of the total composition. Fragrances may be present in the solid composition at an amount of about 0.001 to about 1 wt-%, preferably about 0.01 to about 0.5 wt-%, and more preferably about 0.05 to about 0.2 wt-% of the total composition. Alternatively, the composition may be free of dyes and fragrances.

Embodiments

Exemplary ranges of the solid degreaser compositions according to the invention are shown in Table 1 in weight percentage of the solid compositions.

TABLE 1

Exemplary Solid Degreaser Compositions

| Description | Wt-% | Preferred Wt-% | Most preferred Wt-% |
|---|---|---|---|
| Secondary Alkalinity Source | 30-80 | 40-70 | 50-60 |
| Corrosion Inhibitor | 5-35 | 12-28 | 17-23 |
| Chelant | 0.5-5 | 1-3 | 1.25-1.75 |
| Polyacrylate Polymer | 0.5-10 | 1.5-5 | 2.5-3.5 |
| Alkalinity source | 1-13 | 2-10 | 2-5 |
| Nonionic surfactant | 2-15 | 5-10 | 7-8 |
| Processing Aid | 0-5 | 1-3 | 1.5-2.0 |
| Additional Functional Ingredients | 0-40 | 0-30 | 1-20 |

In addition to the above described preferred quantities of each ingredient, there are preferred ratios of certain ingredients to form the solid degreaser composition. In an aspect of the invention, the ratio of the solvent (e.g. water) to polyacrylate polymer is from about 1:1 to 1:2, or from about 1:1.2 to 1:1.8, or from about 1:1.4 to 1:1.6. In exemplary embodiments, the ratio of solvent (e.g. water) to polyacrylate polymer to source of alkalinity is from about 1:1:1.8 to 1:2:5.3, or from about 1:1.2:2.2 to 1:1.8:3.3, or from about 1:1.4:2.4 to 1:1.6:2.6. The detergent compositions may include concentrate compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the invention.

The use of a concentrated solid eliminates bulk weight for shipping and transport of the degreaser composition, saving time and money. The solid formulation is beneficial over liquid degreaser and pre-soak formulations in that the concentrated solid can be handled without PPE due to specialized packaging to avoid direct contact with skin. A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 1,000 but will depend on factors including water hardness, the amount of soil to be removed and the like. In an embodiment, the concentrate is diluted at a ratio of between about 1:10 and about 1:1,000 concentrate to water. Particularly, the concentrate is diluted at a ratio of between about 1:10 and about 1:500 concentrate to water. More particularly, the concentrate is diluted at a ratio of between about 1:25 and about 1:150 concentrate to water.

The use solution preferably has a pH of 10.5-12.5 and more preferably the pH is 11-12.

Processing and/or Manufacturing of the Composition

In general, a degreaser composition using the components disclosed herein can be created by combining a solid premix and two liquid premixes. The solid and liquid premixes are then combined together to form the solid degreaser composition. The solid degreaser composition may remain as a flowable powder, or may be formed into a solid by any of a number of means including pressing, tableting, and extrusion. Preferably a solid block is formed by pressing.

The ratio of water to polyacrylate polymer, as discussed above, is important to ensure a homogeneous liquid premix once the hydroxide base was added. The order of addition of each component in both liquid premix solutions is important to ensure liquid premix stability as well as power and solid properties of the final formulation.

A solid premix is prepared by mixing together the secondary alkalinity source, corrosion inhibitor, nonionic surfactants, and chelant in a blender until a uniform powder results. Preferably, a ribbon blender is utilized. A first, caustic liquid premix is prepared by mixing a solvent, a polyacrylate polymer, and an alkalinity source in a beaker on a magnetic stir plate, resulting in a homogenous solution. The solvent and polyacrylate polymer are thoroughly mixed before adding the alkalinity source to the solution. The order of addition is integral to forming a stable, homogeneous liquid premix; the addition of the alkalinity source to the polyacrylate polymer results in precipitation. The second, dye-surfactant liquid premix of nonionic surfactant and functional ingredients (e.g. fragrance and dye) is thoroughly mixed in a beaker on a magnetic stir plate. The two liquid premix solutions are added separately to prevent phase separation of the liquid components and to ensure homogeneous liquid coverage onto the power premix. The nonionic surfactant and dye will phase separate from the other liquid raw materials. The caustic liquid premix is combined with the solid premix by pouring or spraying the liquid onto the powder while mixed in the ribbon blender. The dye-surfactant liquid premix is then added to the solid premix and caustic liquid premix and thoroughly combined using a blender forming a uniform, formable powder.

The mixed components were then pressed into a solid form. By the term "solid form", it is meant that the hardened composition will not flow and will substantially retain its shape under moderate stress or pressure or mere gravity. The degree of hardness of the solid composition may range from that of a fused solid product which is relatively dense and hard, for example, like concrete, to a consistency characterized as being a hardened paste. In addition, the term "solid" refers to the state of the degreaser composition under the expected conditions of storage and use of the solid degreaser composition. In general, it is expected that the solid composition will remain in solid form when exposed to temperatures of up to approximately 100° F. and particularly up to temperatures of approximately 120° F. Dimensional stability of the blocks were monitored for four weeks at room temperature, 100° F., and 120° F. The average dimensional change after four weeks was 0.01-0.5% of the initial dimension (in any direction from the solid composition).

Although the degreaser composition is discussed as being formed into a solid product, the degreaser composition may also be provided in the form of a paste. When the concentrate is provided in the form of a paste, enough water is added to the degreaser composition such that complete solidification of the degreaser composition is precluded. In addition, dispersants and other components may be incorporated into the degreaser composition in order to maintain a desired distribution of components.

The present solid composition can be made by an advantageous method of pressing the solid composition. In certain embodiments, the present method employs pressures of about 1000 psi to about 4000 psi. More preferably, the present method employs pressures of about 1500 psi to about 3500 psi, or most preferably pressures of about 2000 psi to about 3000 psi.

The methods can produce a stable solid without employing a melt and solidification of the melt as in conventional casting. Forming a melt requires heating a composition to melt it. The heat can be applied externally or can be produced by a chemical exotherm (e.g., from mixing caustic (sodium hydroxide) and water). Heating a composition consumes energy. Handling a hot melt requires safety precautions and equipment. Further, solidification of a melt requires cooling the melt in a container to solidify the melt and form the cast solid. Cooling requires time and/or energy. In contrast, the present method can employ ambient temperature and humidity during solidification or curing of the present compositions. Caustic compositions made according to the present method produce only a slight temperature increase due to the exotherm. The solids disclosed herein are held together not by solidification from a melt but by a binding agent produced in the admixed particles and that is effective for producing a stable solid.

While the compositions advantageously may be formed to solid by pressing, other methods of solid formation may also be used such as extrusion, cast molding and the like as are known to skilled artisans. Alternatively, the composition may be used in a flowable powder.

Packaging System

The solid composition can be, but is not necessarily, incorporated into a packaging system or receptacle. The packaging receptacle or container may be rigid or flexible, and include any material suitable for containing the compositions produced, as for example glass, metal, plastic film or sheet, cardboard, cardboard composites, paper, or the like. The degreaser compositions may be allowed to solidify in the packaging or may be packaged after formation of the solids in commonly available packaging and sent to distribution center before shipment to the consumer.

For solids, advantageously, in at least some embodiments, since the degreaser composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. In some embodiments, the packaging used to contain the soaking composition is manufactured from a flexible, easy opening film material.

Dispensing/Use of the Degreaser Composition

The degreaser composition can be dispensed as a concentrate or as a use solution. In addition, the degreaser composition concentrate can be provided in a solid form or in a liquid form. In general, it is expected that the concentrate will be diluted with water to provide the use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a degreasing or pre-soak application, for example, in a warewashing machine, a soaking vessel, exteriors of vessels, such as boilers and fryers, and the like. In some embodiments, formation of a use solution can occur from a degreasing agent installed in a dispenser. The degreasing agent can be diluted and dispensed from a dispenser mounted on or in the soaking vessel or from a separate dispenser that is mounted separately but cooperatively with the soaking vessel.

In other example embodiments, solid products may be conveniently dispensed by inserting a solid material in a container or with no enclosure into a spray-type dispenser such as the volume SOL-ET controlled ECOTEMP Injection Cylinder system manufactured by Ecolab Inc., St. Paul, Minn. Such a dispenser cooperates with a washing machine or soaking vessel. When demanded by the machine, the dispenser directs water onto the solid block of agent which effectively dissolves a portion of the block creating a concentrated aqueous degreaser solution which is then fed directly into the water forming the aqueous degreaser solution. The aqueous degreaser solution is then contacted with the surfaces to affect a soaking composition. This dispenser and other similar dispensers are capable of controlling the effective concentration of the active portion in the aqueous composition by measuring the volume of material dispensed, the actual concentration of the material in the water (an electrolyte measured with an electrode) or by measuring the time of the spray on the solid block.

Alternatively, the solid degreasing composition may be placed into a soaking vessel and diluted by addition of water to the soaking vessel. The solid dissolves in the water to produce a use solution.

The diluted degreasing composition may be used to soak and loosen soils on various wares used for food preparation. In particular, the degreaser composition is effective for loosening baked-on and caramelized soils and other greasy, oily soils. These include soils from breads, pastries, and meat products. Such wares may be made of soft metal such as aluminum and include bakery pans, deli pans, baking sheets, muffin tins, and the like.

Wares are treated by placing the wares into a soaking vessel and submerging the wares in the diluted degreasing solution. In order to provide effective loosening of soils, the diluted degreasing composition is preferably applied to the wares to be cleaned for at least 12 hours. Preferably, the wares are soaked for 5-24 hours, and more preferably 12-18 hours. Then, the wares may be washed by typical methods, such as in a dishwashing machine.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The following ingredients are utilized in the Examples:

Sodium Carbonate Light—Light Soda Ash

Sodium Carbonate Dense—Dense Soda Ash

Sodium Metasilicate Pentahydrate—Metso Pentabead 20 (PQ Corporation; Valley Forge, Pa.); Uniflo 26 (Occidental Chemical Corporation; Dallas, Tex.)

Sodium Silicate—Britesil H20 hydrous sodium silicate; Britesil H20 (PQ Corporation; Malvern, Pa.)

Trisodium Citrate Dihydrate—Sodium Citrate

Water—Zeolite Softened Water

Polyacrylic Acid Sodium Salt—Acusol 445 N (Rohm and Haas; Philadelphia, Pa.)

Sodium Hydroxide (50% solution)—Caustic

Linear Ethoxylated Alcohol C11, 3 moles EO—Tomadol 1-3 (Air Products; Allentown, Pa.)

Linear Ethoxylated Alcohol C10-12, 3 moles EO—Sulfonic L12-3 (Huntsman Corporation; The Woodlands, Tex.); Tomadol 91-2.5 (Air Products; Allentown, Pa.)

Fragrance—Orange Fragrance SZ-40173 (J&E Sozio, Inc.; Edison, N.J.)

Dye—Liquitint Brilliant Orange (Milliken Chemical; Spartanburg, S.C.)

Ethoxylated Fatty Alcohol C16-C18, 25 moles EO—Lutensol AT-25 (BASF; Germany); Teric 17A25 (Huntsman; The Woodlands, Tex.).

Alanine,N,N-bis(carboxymethyl)-,trisodium salt—Trilon M (BASF; Germany)

Example 1: Phase Separation and Precipitation of Polymer in Degreaser Formula A The invention of a pressed solid degreasing soak formula involves the combination of both solid and liquid raw material components, such that the end result is a flowable powder that can be pressed and molded into a pressed solid block. The balance of liquid and solid raw materials, in the right proportions, and the order of addition is integral to a successful process. A solid powder that is too wet, sticky, or dry resulted in deleterious effects on the final pressed solid product. The order of addition and formation of stable liquid premix solutions was an important aspect of developing a pressed solid degreasing soak product.

Experimental formulations based upon existing pre-soak compositions were tested to develop a solid soak tank product. The desired formulation would be effective at removing baked-on carbonized soil from aluminum baking pans.

TABLE 2

| Degreaser Formula A | |
|---|---|
| Percent | Ingredient |
| 61.2 | Sodium Carbonate Light |
| 20 | Sodium metasilicate pentahydrate |
| 3.86 | Trisodium citrate dihydrate |
| 2.85 | Water |
| 2 | Polyacrylic acid sodium salt |
| 5 | NaOH 50% |
| 0.834 | Linear Ethoxylated Alcohol C11, 3 moles EO |
| 4.167 | Linear Ethoxylated Alcohol C10-12, 3 moles EO |
| 0.0 | Fragrance |
| 0.1 | Dye |

First, a solid premix including sodium carbonate light, sodium metasilicate pentahydrate, and trisodium citrate dehydrate was mixed together to form a powder. Then, water, polyacrylic acid sodium salt, NaOH 50%, linear ethoxylated alcohol (LAE) C11, LAE C10-12, dye, and fragrance were added together and stirred to form a liquid premix. The liquid mixture was allowed to sit under static conditions before being added to the solid powder mixture. A phase separation was observed; a more dense gel phase formed on the bottom, and a lighter, water thin liquid phase on top. The polyacrylic acid had phase-separated from the liquid mixture.

A homogeneous liquid premix is needed in order to ensure thorough mixing of the raw materials onto the powder main mix. The formation of stable, homogeneous liquid premix solution was important for the manufacturing processes in order for the liquid premix solution to be pumped into the powder blender. A homogeneous liquid phase is required to ensure all raw materials are uniformly transferred to the solid powder mixture. The stability of the liquid premix is required for processing situations in which the premix solution must be prepared some time in advance to blending the final product.

It was discovered that combining the water, polyacrylic acid, and NaOH formed the stable, homogeneous caustic liquid premix solution, and the combination of LAE, dye, and fragrance formed the stable, homogeneous dye-surfactant liquid premix solution. The addition of the dye and fragrance to the water, polyacrylic acid, and NaOH mixture resulted in a phase separation. When the dye is mixed into water a homogeneous phase is formed; a phase separation was observed when the polyacrylic acid was added to the water-dye mixture. Further separation occurred with the addition of the fifty percent sodium hydroxide solution. The order of addition of the raw materials was discovered to affect the stability of the caustic liquid premix solution. The addition of the caustic solution directly to the polyacrylic acid results in the formation of a solid precipitate. The formation of a stable, homogenous caustic liquid premix was achieved when the polyacrylic acid was thoroughly mixed with the free water charge before the addition of the caustic solution.

The ratio of water to anionic polymer (polyacrylic acid/polyacrylate polymer) to caustic solution (sodium hydroxide) was particularly important to forming a homogeneous solution. A one to one mass ratio of water to anionic polymer was prepared by thoroughly mixing 50 grams of Acusol 445 N into 50 grams of water. A fifty percent solution of sodium hydroxide was added to the water-anionic mixture with stirring. The caustic solution was slowly added until the solution turned cloudy and started to thicken. A 1:1:5.3 ratio of water:anionic:caustic solution remained stable and homogeneous. The addition of the caustic solution beyond this point resulted in the mixture increasing in thickness and a phase separation was observed at 1:1:7.1 ratio of water:anionic:caustic solution.

Example 2: Use of Solid and Liquid Premixes to Avoid Phase Separation in Degreaser Formula B This formulation was developed to have three separate premixes to avoid phase separation upon combining all ingredients into the final composition.

TABLE 3

| Degreaser Formula B | |
|---|---|
| Percent | Ingredient |
| ~70.66 | Sodium Carbonate Light |
| 10 | Sodium Metasilicate Pentahydrate |
| 3.91 | Sodium Citrate |
| 5.70 | Water |
| 2.01 | Polyacrylic acid sodium salt |
| 2.5 | NaOH 50% |
| 0.84 | LAE C11 3 mole EO |
| 4.23 | LAE C10-12 3 mole EO |
| 0.05 | Fragrance |
| 0.10 | Dye |

The solid premix of sodium carbonate light, sodium metasilicate, and sodium citrate was thoroughly mixed in a 1400 mL beaker with a spoon by hand. The caustic liquid premix of water, polyacrylic acid sodium salt, and NaOH was mixed on a stir plate. Once thoroughly mixed, the caustic liquid premix was added to the solid premix and thoroughly mixed with a spoon. The dye-surfactant liquid premix of LAE C11, LAE C10-12, fragrance, and dye was thoroughly mixed. Then the dye-surfactant liquid premix was added to the powder of solid premix and caustic liquid premix and thoroughly combined. During the mixing process, the liquid premixes remained stable.

This formulation beneficially avoided phase separation and precipitation of the polyacrylic acid upon mixing. Use of two separate liquid premixes allowed for the solid ingredients to be mixed with the liquid ingredients in phases so that the polyacrylic acid did not precipitate out of solution.

Example 3: Degreaser Formula C Targeting PPE-Free pH

TABLE 4

| Degreaser Formula C | |
|---|---|
| Percent | Ingredient |
| 66.11 | Sodium Carbonate Light |
| 5.00 | Sodium Metasilicate Pentahydrate |
| 7.33 | Trisodium Citrate Dihydrate |
| 5.0 | Water |
| 2.01 | Polyacrylic acid sodium salt |
| 2.5 | NaOH 50% |

TABLE 4-continued

| Degreaser Formula C | |
|---|---|
| Percent | Ingredient |
| 1.99 | Linear Ethoxylated Alcohol C11 3 mole EO |
| 9.90 | Linear Ethoxylated Alcohol C10-12 3 mole EO |
| 0.05 | Fragrance |
| 0.1 | Dye |

The goal of this formulation was to reduce the pH and reduce corrosion while still achieving effectiveness in removing soils. The amounts of the ingredients of the formulation were adjusted to achieve this end. The target pH is less than or equal to 11.5 in order to be a PPE-Free formulation. In particular, the amount of sodium metasilicate was reduced to lower the pH of the composition.

The solid premix of sodium carbonate light, sodium metasilicate, and sodium citrate was thoroughly mixed in a 1400 mL beaker. The caustic liquid premix of water, polyacrylic acid, and NaOH 50% was mixed thoroughly on a magnetic stir plate, resulting in a clear, homogenous mixture. The caustic liquid premix was added to the solid premix and thoroughly combined with a spoon. The dye-surfactant liquid premix of alcohol C11 3 mole EO, linear ethoxylated alcohol C10-12, fragrance, and dye was thoroughly mixed. Then the dye-surfactant liquid premix was added to the powder of solid premix and caustic liquid premix and thoroughly combined. The results of the assessment show that the reduced amount of caustic alkalinity to obtain a pH below 11.5 decreased performance efficiency.

Example 4: Comparison of Formulas B and C with Existing Pre-Soak Products

Experimental formulas B and C were prepared as described above in Examples 2 and 3. These experimental solutions were compared with the performance of commercially-available control formulations. Water was used as a negative control in a soak test.

TABLE 5

| Positive Control | |
|---|---|
| Percent | Ingredient |
| 0 | Water |
| 30-40 | Sodium Silicate |
| 5-10 | Potassium hydroxide |
| 1-<3 | β-alanine, N-(2-carboxyethyl)-N-dodecyl-, sodium salt |
| 0 | Sodium acrylate |

TABLE 6

| Positive Control Pot & Pan Soak Formula | |
|---|---|
| Percent | Ingredient |
| 60-70 | Sodium Carbonate |
| 15-30 | Sodium Silicate |
| 3-5 | Sodium Citrate Dihydrate |
| 2-4 | Water Zeolite Softened |
| 1-3 | Polyacrylic Acid 46% |
| 1-3 | Poly Maleic Acid 50% |
| 1-3 | Polyacrylic Acid Sodium Salt |
| 0.1-1 | ATMP 50% (for solid products only) |
| 1-3 | NaOH 50% Liquid |
| 0.1-1 | Dyes/Fragrance |

TABLE 6-continued

| Positive Control Pot & Pan Soak Formula | |
|---|---|
| Percent | Ingredient |
| 0.5-1.5 | Alcohol (C11) 3 mole EO |
| 4-6 | Linear C12-C16 Alcohol 7 Mole Ethoxylate |

The various solutions were tested on high carbon soiled muffin pans. After soaking for 3 days, the solutions were all dark, possibly indicating black carbon soil removal from surfaces.

FIG. 1 shows a heavily carbon-soiled muffin pan. Each of the five columns of the muffin pan was used to test performance of four different test solutions as well as a water control. The solutions used in each column were Ash-Based Control T6 (Column 1), Experimental Solution B (Column 2), Water (Column 3), Experimental Solution C (Column 4), and Control T5 (Column 5). Each row of the muffin pan served as triplicates. Visual observation of the amount of soil removed was used to assess the performance of the different solutions.

The 2% B and C solutions exhibited greater carbon removal than both controls T5 and T6. Minimal soil removal was observed for the water control. Both Experimental B and C solutions had comparable performance to each other. The Experimental C solution demonstrated a bit more carbon removal than the Experimental B solutions at 2%. Some white residue was observed at the air-liquid interface for all solutions; the residue was initially noted as silicate staining. Silicate staining often occurs at the air-liquid interface of a silicate containing solution. White residue indicated as silicate staining was not silicate staining. The white stain was removed from surface after thoroughly rinsing the soap solution. The white residue was residual chemistry, primarily sodium carbonate, left after drying.

This test was duplicated every 24 hours for a total of 72 hours of static soak for each solution. Substantial carbon soil remained, but the highest level of carbon soil removal was achieved with Experimental B and C formulae. This indicated the efficacy of the experimental formulations by comparison to existing products. The solid composition proved to be as effective as or more effective than liquid compositions for removing soil.

Example 5: Optimized Formula D

Modifications to the Experimental Formulae B and C were investigated in attempts to balance performance and lower use solution pH for regulatory purposes. Formulation variables that were changed include the concentrations of sodium hydroxide, sodium metasilicate, nonionic surfactant, and water.

To increase performance and processing of the pressed solid formulation, the sodium hydroxide concentration was increased as well as sodium metasilicate. An increase in sodium hydroxide concentration required an increase in sodium metasilicate to ensure soft metal protection. The sodium metasilicate serves as a corrosion inhibitor and provides metal protection to the aluminum bakery wares. The formula shown below demonstrated desired performance and improved processing qualities.

TABLE 7

| Degreaser Formula D | |
|---|---|
| Percent | Ingredient |
| 58.99 | Sodium Carbonate Light |
| 20.0 | Sodium Metasilicate Pentahydrate |
| 3.86 | Trisodium Citrate Dihydrate |
| 5.0 | Water |
| 2.0 | Polyacrylic Acid Sodium Salt |
| 5.0 | NaOH 50% |
| 2.5 | Linear Ethoxylated Alcohol C11, 3 mole EO |
| 2.5 | Linear Ethoxylated Alcohol C10-12, 3 mole EO |
| 0.15 | Fragrance, Dyes |

Figure 2:
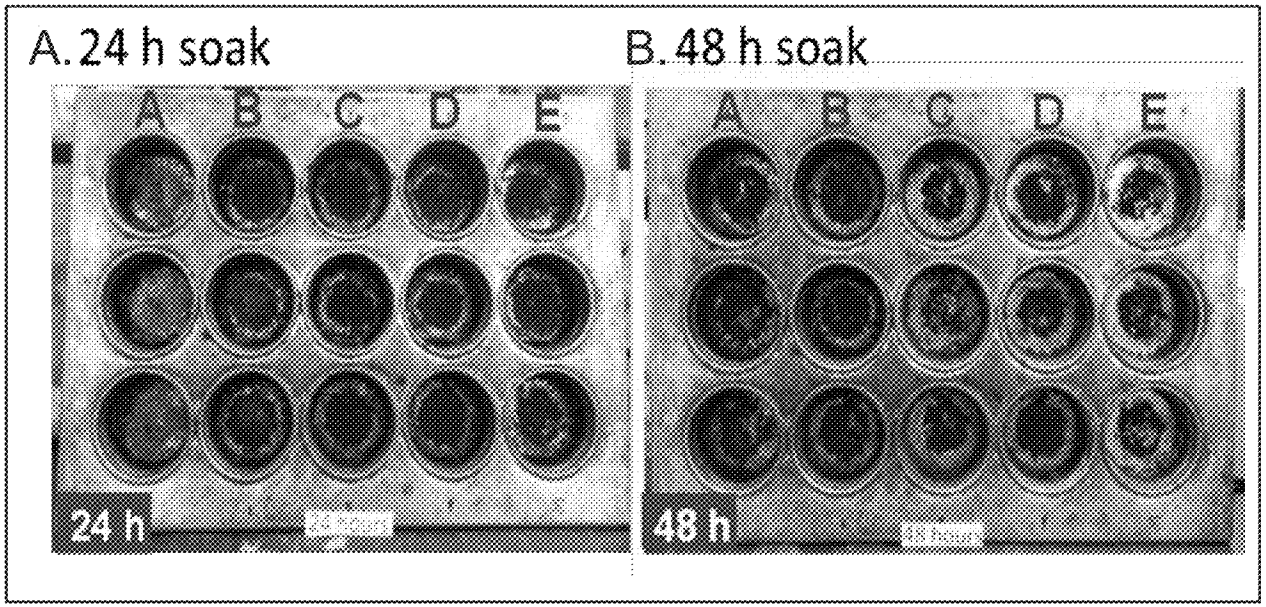
FIG. 2 shows the results of a performance test of an embodiment of the degreaser compositions diluted at different rates.

Formula D was tested at 1%, 1.5%, and 2% dilutions and compared to 10% liquid Control T6 formulation and 1.33% Control T5 formulation. The solutions were added to a soiled aluminum muffin pan and allowed to soak for 24 or 48 hours. Photos were taken of each muffin pan well after the 24 hour soak time (FIG. 2) and cropped to include each individual well only and color adjusted by saturation (−100) and amount (100) giving a black and white photo.

Black and white photographs of aluminum muffin pans after static soak were analyzed using the National Instruments Vision Builder for Automated Inspection (2009) to obtain quantitative measurement of soil removed. The dark objects in the photographs were selected, representing soiled areas. The percent of pixel represents soiled area and 1-% represents soil removal as shown in Table 8. The performance data for the Experimental Formulation D indicated that the 1.5% solution performed equal to the 10% solution of liquid Control T6 formula and the 2% solution exceeded the performance of the control.

TABLE 8

| Percent Soil Removed (Vision System) | | | |
|---|---|---|---|
| Column | Product | 24 h soak | 48 h soak |
| A | Control T5 (1.33%) | 16.2% | 25% |
| B | Experimental 1 (1%) | 17.5% | 21.3% |
| C | Control T6 (10%) | 22.9% | 44.4% |
| D | Experimental 2 (1.5%) | 22.8% | 38.6% |
| E | Experimental 3 (2%) | 27.8% | 54.4% |

Formula D was the first of the experimental iterations to be scaled up in the 1.3 $ft^3$ ribbon blender. A thirty-pound batch of Experimental Formula D was made by adding all the solid raw materials to the ribbon blender. Once thoroughly mixed, the caustic and dye-surfactant liquid premixes were added to the powder. The caustic premix was thoroughly blended into the powder before the addition of the dye-surfactant liquid premix. The small scale-up of the formulation proved to be successful.

Formula D had good cleaning performance compared to control and competitive chemistries. Further, the Formula D proved to have good processability, forming a free-flowing powder that was easily pressed into a solid block.

Example 6: Batch Preparation of Formula E

TABLE 9

| Degreaser Formula E | |
|---|---|
| Percent | Description |
| 62.1 | Sodium Carbonate Light |
| 20 | Sodium Metasilicate Pentahydrate |

TABLE 9-continued

| Degreaser Formula E | |
|---|---|
| Percent | Description |
| 3 | Trisodium Citrate Dihydrate |
| 2.5 | Ethoxylated Fatty Alcohol C16-C18, 25 moles EO |
| 2 | Water |
| 1 | Polyacrylic Acid Sodium Salt |
| 6.7 | NaOH (50%) |
| 2.5 | Linear Ethoxylated Alcohol C10-12, 3 moles EO |
| 0.2 | Dye, Fragrance |

Modifications to Experimental Formula D were performed in order to reduce the amount of sticking observed during the press process. The water content and acrylic polymer was reduced as shown in Table 9. The percentage of sodium hydroxide solution was increased to bring in some water as well as improve performance. The liquid Tomadol 1-3 nonionic surfactant (LAE C11) was replaced with a solid nonionic surfactant, Lutensol AT-25 (LAE C16-18). The solid nonionic surfactant has a large carbon chain length compared to the previous liquid surfactant. The addition of a longer chain nonionic surfactant was beneficial for longer soak times.

The LAE C10-12, dye, and orange fragrance were combined to form the dye-surfactant premix. Water and Polyacrylic Acid Sodium Salt were added in a metal container and mixed until uniform to form the caustic premix. Temperature was recorded. NaOH 50% liquid was slowly added by stirring until uniform. Temperature increase of the caustic premix was recorded. The Sodium Carbonate was added to the blender followed by the sodium metasilicate pentahydrate, LAE C16-18, and Sodium Citrate Dihydrate. The caustic premix was slowly poured into the blender and blended until uniform. Then the dye-surfactant premix was added and blended until uniform. Note that in this formulation, the liquid linear ethoxylated alcohol C10-C12 was replaced with Lutensol AT 25 powder, so this component was in the solid premix instead of the dye liquid premix.

Formula E was also scaled to a thirty-pound batch. The changes to reduce the amount of powder sticking to press equipment proved to be successful. Minimal sticking was observed in the ribbon blender, on the press table, and on the press shoe. The improvements resulted in moving to larger, two-thousand pound scale up.

Example 7: Stability Testing of Formula E

Formula D was prepared as premixes and tested for stability. The liquid premixes were prepared and divided into aliquots in four different conditions:

1. ambient temperature (in lab)
2. 120 degrees Fahrenheit (in oven)
3. 36 degrees Fahrenheit (in refrigerator)
4. 32 degrees Fahrenheit (in freezer)

The samples were left for 6 weeks to determine if the stability of premix solutions were acceptable. Both liquid premix solutions were found to be stable; the premix solutions remained homogeneous at all test conditions except 32° F. At 32° F. both liquid pre-mix solutions were frozen; once the premix solutions were allowed to return to ambient condition both became homogeneous.

These results are significant because it is beneficial to be able to prepare the liquid premixes in advance of making the final degreaser composition. The premixes can be prepared and stored ahead of time, remaining stable until ready for use.

Example 8: Performance Testing of Formula E

Modifications were made to Formula D to improve certain processing characteristics and block quality; specifically changes were made to formula to decrease the amount of chemistry sticking to press equipment and improve block hardness and edges.

The performance of formula E was compared to a commercially control presoak composition by comparing soil removal after static soak tests. Formula E and control were diluted to a use solution of 1.2% and 10%, respectively.

Two soiled bakery pans, with heavy carbonized soil, were collected from the field. The pans were labeled "Pan 1" and "Pan 2". Two soak tanks were filled with the two test solutions: 1.2% use solution of formula E and 10% use solution of control presoak composition. The soak tanks were filled with enough of each use solution that ⅓ of the bakery pan was submerged (about three gallons). Pan 1 was soaked in formula E 1.2% solution and Pan 2 was soaked in the 10% control presoak composition. After 24 hours the pans were removed, rinsed with cold tap water, flipped and placed into the other use solution and soaked for another 24 hours; the middle of each pan remained soiled. This allowed for comparison between formula E and SuperSoak against the initial soil load of the pan (middle ⅓ section of the pan—see FIG. 3). This was repeated for a total of 48 hours of static soak time.

Figure 3:
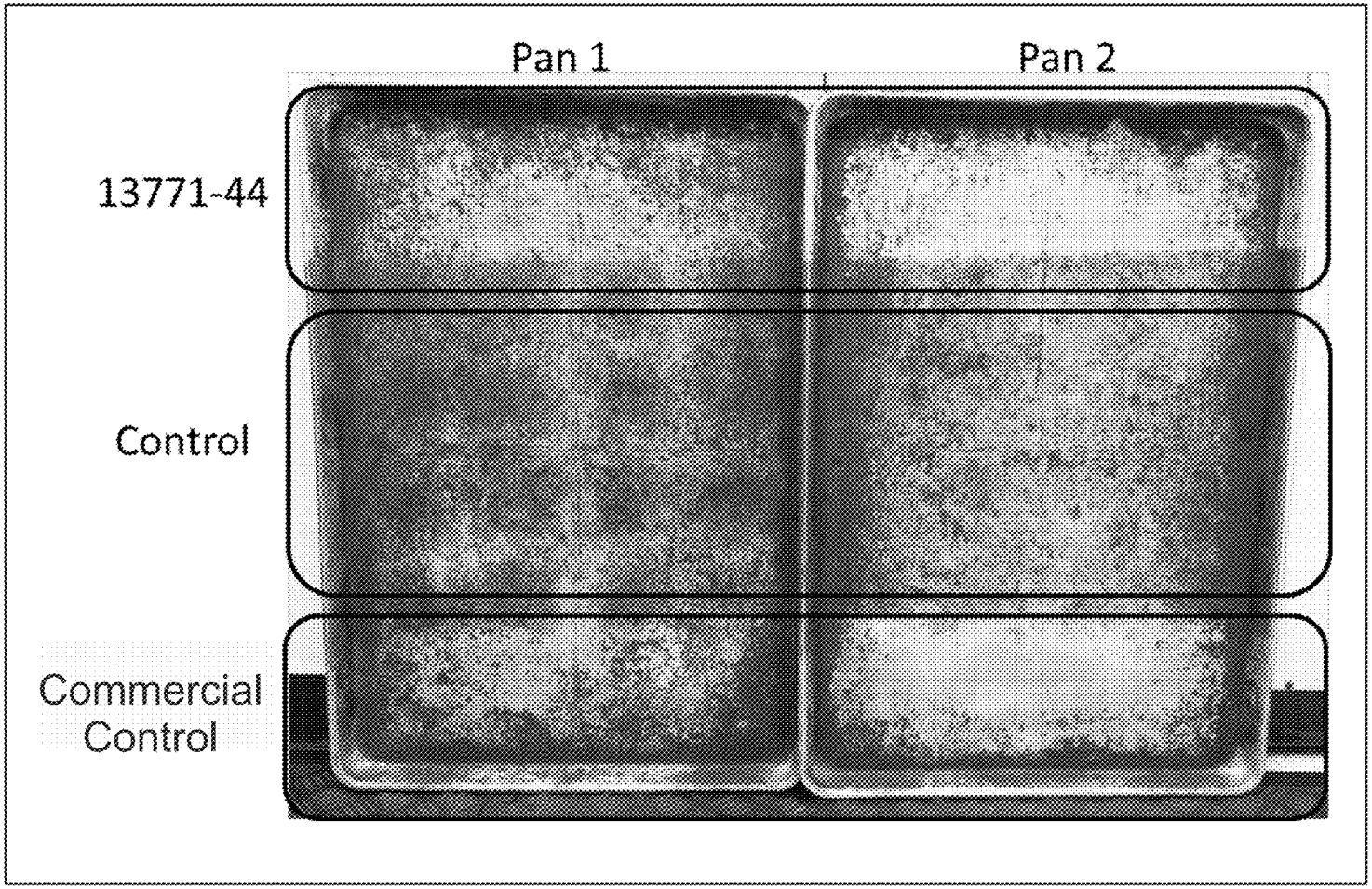
FIG. 3 shows the results of a performance test comparing the effectiveness of the solid degreaser and pre-soak compositions and a Positive (commercial) control formula.

A BYK colorimeter was used to collect data from the pans. Fifteen measurements were taken for each pan. Then the pans were allowed to soak in the solutions for another 24 hours. Results indicate that the performance of formula E is equal to that of liquid SuperSoak™ (FIG. 3). The change in L* values, ΔL*, indicates the experimental formula performs as well as the current liquid control presoak composition.

TABLE 10

BYK Colorimeter Results for Formula E

| | N | L* | a* | b* | ΔL* |
|---|---|---|---|---|---|
| 24 hour soak results | | | | | |
| Pan 1 | | | | | |
| Formula E 1.2% | 15 | 35.39 | 3.76 | 8.099999 | 5.86 |
| Control NT | 15 | 31.62 | 7.89 | 12.87 | |
| Control liquid presoak (10%) | 15 | 33.54 | 5.32 | 10.08 | 2.98 |
| Pan 2 | | | | | |
| Formula E 1.2% | 15 | 40.13 | 1.44 | 5.41 | 1.65 |
| Control NT | 15 | 39.19 | 4.87 | 10.37 | |
| Control liquid presoak (10%) | 15 | 40.9 | 1.66 | 5.81 | 3.01 |
| 48 hour soak results | | | | | |
| Pan 1 | | | | | |
| Formula E 1.2% | 15 | 38.77 | 2.81 | 6.20 | 15.69 |
| Control NT | 15 | 28.12 | 8.80 | 11.05 | |
| Control liquid presoak (10%) | 15 | 39.77 | 1.78 | 5.06 | 17.16 |
| Pan 2 | | | | | |
| Formula E 1.2% | 15 | 52.28 | −0.35 | 0.48 | 20.62 |
| Control NT | 15 | 40.92 | 5.60 | 11.40 | |
| Control liquid presoak (10%) | 15 | 52.73 | −0.09 | 3.06 | 21.44 |

TABLE 10-continued

BYK Colorimeter Results for Formula E

| | Average Percent Clean ΔL* | |
|---|---|---|
| | 24 h | 48 h |
| Formula E | 3.76 | 18.16 |
| Control liquid presoak | 3.00 | 19.30 |

It is beneficial that a solid degreaser and pre-soak formulation has been developed which is at least as effective as an existing liquid control pre-soak formulation. In addition to efficacy as a pre-soak treatment, the solid composition has the added benefits of being a pressed solid. Formulation E proved to have desired cleaning properties as well as desirable powder properties for manufacturing into a pressed solid chemistry.

Example 9: Aluminum Protection Studies

Aluminum coupons were cut from an unused bakery pan. The aluminum coupons were soaked in a 1.2 wt % use solution of Formula E and F, and allowed to soak under static conditions for 72 hours. The coupons were removed from use solution and thoroughly washed with water, removing any excess chemistry. The coupons were visually analyzed for changes in surface and surface color that would indicate corrosion. The coupons remained metallic, shiny and smooth.

The coupons were further analyzed using scanning electron microscopy (SEM) coupled with energy-dispersive X-ray spectroscopy (EDX). The analysis indicated the presence of silicon, which resulted from the formation of an Al—O—Si layer, serving as a chemically resistant protection layer.

Example 10: Degreaser Formula F to Addition of Water Conditioning Active

The application of the solid soak/degreaser formula was designed to be dispensed. A water conditioning active was needed to ensure sufficient performance in hard water and mitigate potential dispenser clogs due to hard water. Trilon M (Alanine,N,N-bis(carboxymethyl)-,trisodium salt) was used as the chelating agent for this application and was added as a solid raw material into the powder main premix (additive to Formula F shown below); other chelants such as EDTA can be substituted in the formulation as well. Dense soda ash was used instead of light density soda ash due to moisture absorption effects as well as increasing batch size. The sodium metasilicate was replaced with sodium silicate due to changes in appearance of the aluminum test coupons when sodium metasilicate was used.

TABLE 11

Degreaser Formula F

| Percent | Description |
|---|---|
| 57.85 | Sodium Carbonate Dense |
| 20.00 | Sodium Silicate |
| 3.00 | Trisodium Citrate Dihydrate |
| 5.00 | Ethoxylated Fatty Alcohol C16-C18, 25 moles EO |
| 2.00 | Water |
| 3.00 | Polyacrylic Acid Sodium Salt |
| 5.00 | NaOH (50%) |
| 2.50 | Linear Ethoxylated Alcohol C10-12, 3 moles EO |

TABLE 11-continued

| Degreaser Formula F | |
|---|---|
| Percent | Description |
| 1.50 | Alanine, N,N-bis(carboxymethyl)-, trisodium salt |
| 0.05 | Dye |
| 0.10 | Orange Fragrance |

Formulation F was scaled up to a 35 pound batch; three batches were ran in campaign to evaluate processability of the formulation such as flowability through the blender and powder sticking to blender and press equipment. Photographs from the three 35 pound batch campaign are presented in Formula F was scaled up to a 2000 pound batch to determine if the formula iteration was viable for processing on a larger scale. Flowability of the powder through the blenders, surge blender, rotary valve, and All-Fill Filler was investigated as well as the degree of powder sticking to blender and press equipment. It was determined the powder flowability was suitable for large scale and no issues with powder sticking; this result is desirable for large scale manufacturing.

Example 11: Degreaser Formula G to Addition of Processing Aid

Modifications to the degreaser formulation were designed to further improve the manufacturing process. Modifications presented in Formulation G include the incorporation of liquid sucrose as a processing aid and a blend of sodium carbonate density. Formula G was scaled up to multiple 2000 pound batch campaigns. It was determined that formulation G was suitable for large scale manufacturing.

TABLE 12

| Degreaser Formula G | |
|---|---|
| Percent | Description |
| 54.48 | Sodium Carbonate Dense |
| 2.87 | Sodium Carbonate Light |
| 20.00 | Sodium Silicate |
| 3.00 | Trisodium Citrate Dihydrate |
| 5.00 | Ethoxylated Fatty Alcohol C16-C18, 25 moles EO |
| 0.656 | Water |
| 1.969 | Liquid Sucrose (65%) |
| 2.625 | Polyacrylic Acid Sodium Salt |
| 5.250 | NaOH (50%) |
| 2.598 | Linear Ethoxylated Alcohol C10-12, 3 moles EO |
| 1.50 | Alanine, N,N-bis(carboxymethyl)-, trisodium salt |
| 0.052 | Dye |

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A solid composition comprising:

a solid premix comprising a secondary alkalinity source comprising sodium carbonate, a corrosion inhibitor comprising a silicate and/or metasilicate, and at least one chelant comprising sodium citrate;

a first liquid premix comprising from about 2 wt-% to about 10 wt-%, based on the weight of the total solid composition, of a primary alkalinity source comprising an alkali metal hydroxide, from 0.01 wt-% to about 6 wt-%, based on the weight of the total solid composition, of a polyacrylate polymer comprising a polyacrylic acid sodium salt, and water; and a second liquid premix comprising at least one nonionic surfactant comprising one or more alcohol ethoxylates and one or more additional functional ingredients comprising a dye and/or a fragrance;

wherein the ratio of the primary alkalinity source to the water to the polyacrylate polymer is 1.8:1:1 to less than 7.1:1:1; and wherein the solid premix, the first liquid premix, and the second liquid premix are combined to form a stable solid.

2. The solid composition of claim 1, wherein the composition comprises from about 30 wt-% to about 80 wt-% of the secondary alkalinity source and from about 2 wt-% to about 5 wt-% of the primary alkalinity source.

3. The solid composition of claim 1, wherein a use solution of the composition has a pH from about 11 to about 12.

4. The solid composition of claim 1, wherein a use solution of the composition has a pH from about 10 to about 13.

5. The solid composition of claim 1, further comprising a saccharide processing aid.

6. The solid composition of claim 1, wherein the composition comprises from about 5 wt-% to about 35 wt-% of the corrosion inhibitor.

7. The solid composition of claim 1, wherein the one or more alcohol ethoxylates are linear alcohol ethoxylates.

8. The solid composition of claim 1, wherein the composition comprises from about 0.5 wt-% to about 10 wt-% of the at least one chelant.

9. The solid composition of claim 1, comprising from about 2 wt-% to about 5 wt-% of the primary alkalinity source, from about 50 wt-% to about 60 wt-% of the secondary alkalinity source, from about 17 wt-% to about 23 wt-% of the corrosion inhibitor, from about 2.5 wt-% to about 3.5 wt-% of the polyacrylate polymer, from about 7 wt-% to about 8 wt-% of the nonionic surfactant, and from about 1.25 wt-% to about 1.75 wt-% of the chelant.

10. A solid degreaser composition comprising:

a solid premix comprising from about 30 wt-% to about 80 wt-%, based on the weight of the total solid composition, of a secondary alkalinity source; wherein the secondary alkalinity source comprises sodium carbonate, and from about 5 wt-% to about 35 wt-%, based on the weight of the total solid composition, of at least one silicate corrosion inhibitor comprising an alkali metal silicate or metasilicate, from about 0.5 wt-% to about 5 wt-%, based on the weight of the total solid composition, of at least one chelant comprising sodium citrate;

a first liquid premix comprising from about 2 wt-% to about 10 wt-%, based on the weight of the total solid composition, of a primary alkalinity source comprising an alkali metal hydroxide, from about 0.5 wt-% to about 6 wt-%, based on the weight of the total solid composition, of at least one polyacrylate polymer, and water; and a second liquid premix comprising from about 2 wt-% to about 15 wt-%, based on the weight of the total solid composition, of at least one nonionic surfactant comprising at least one alcohol ethoxylate and one or more additional functional ingredients comprising a dye and/or a fragrance;

wherein the ratio of the primary alkalinity source to the water to the polyacrylate polymer is 1.8:1:1 to less than 7.1:1:1; and wherein the solid premix, the first liquid premix, and the second liquid premix are combined to form a stable solid.

11. The solid degreaser composition of claim 10, wherein the composition comprises from about 2 wt-% to about 5 wt-% of the primary alkalinity source.

12. The solid degreaser composition of claim 10, wherein the composition comprises from about 12 wt-% to about 28 wt-% of the at least one silicate corrosion inhibitor.

13. The solid degreaser composition of claim 10, wherein the composition comprises from about 3 wt-% to about 7 wt-% of the primary alkalinity source.

14. The solid degreaser composition of claim 10, wherein the composition comprises from about 1.5 wt-% to about 5 wt-% of the polyacrylate polymer.

15. The solid degreaser composition of claim 10, wherein the composition comprises from about 5 wt-% to about 10 wt-% of the at least one nonionic surfactant.

16. The solid degreaser composition of claim 10, wherein the composition comprises from about 1 wt-% to about 3 wt-% of the chelant.

17. The solid degreaser composition of claim 10, wherein the composition comprises from about 1 wt-% to about 20 wt-% of the one or more additional functional ingredients.

18. The solid degreaser composition of claim 10, wherein a use solution of the composition has a pH from about 10 to about 13.

19. The solid degreaser composition of claim 10, further comprising a saccharide processing aid.

20. A method of making a solid composition according to claim 1, comprising:

preparing the solid premix, the first liquid premix and the second liquid premix;

combining the solid premix, the first liquid premix and the second liquid premix to form a powder; and pressing the powder into a solid composition.

21. The method of claim 20, wherein the combining is done by mixing and the pressing turns the powder into blocks.

22. A method of treating wares before washing, comprising: providing the solid composition according to claim 1;

diluting the solid composition in water to form a use solution; and submerging the wares in the use solution.

23. The method of claim 22, wherein the wares are metal deli and bakery pans.

24. The method of claim 22, wherein the submerging step lasts for 8-12 hours.

25. The method of claim 22, wherein the use solution contains from about 1 wt-% to about 2 wt-% of the solid composition.

26. The method of claim 22, wherein the diluting and submerging steps occur in a soaking vessel.

* * * * *